US009587335B2

(12) United States Patent
Shomura et al.

(10) Patent No.: US 9,587,335 B2
(45) Date of Patent: Mar. 7, 2017

(54) THREADING DEVICE OF A SEWING MACHINE

(71) Applicant: Janome Sewing Machine Co., Ltd., Tokyo (JP)

(72) Inventors: Eiichi Shomura, Tokyo (JP); Ushio Yokoyama, Tokyo (JP); Shintaro Haraguchi, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 68 days.

(21) Appl. No.: 14/705,855

(22) Filed: May 6, 2015

(65) Prior Publication Data

US 2016/0145787 A1 May 26, 2016

(30) Foreign Application Priority Data

Nov. 26, 2014 (JP) ..... 2014-239388

(51) Int. Cl.
*B65H 57/00* (2006.01)
*D05B 87/02* (2006.01)

(52) U.S. Cl.
CPC ..... *D05B 87/02* (2013.01); *D05D 2207/04* (2013.01)

(58) Field of Classification Search
CPC ..... D05B 87/02; D05B 57/08; D05B 57/36; D05B 87/00; D05B 87/04; D05D 2207/04
USPC ..... 112/302
See application file for complete search history.

(56) References Cited

U.S. PATENT DOCUMENTS 2,413,014 A 12/1946 Wall
5,327,841 A 7/1994 Sakuma
2004/0149192 A1* 8/2004 Horiuchi ..... D05B 87/02 112/199
2008/0236466 A1* 10/2008 Sadasue ..... F05D 57/30 112/302
2015/0267332 A1 9/2015 Shomura
(Continued)

FOREIGN PATENT DOCUMENTS

GB 1448395 A 9/1976
JP 06-277383 A 10/1994

OTHER PUBLICATIONS

Patent Examination Report issued in Australian Patent Application No. 2015202620, dated on Feb. 5, 2016 (5 pages).

*Primary Examiner* — Nathan Durham
(74) *Attorney, Agent, or Firm* — Nakanishi IP Associates, LLC

(57) ABSTRACT

A threading device of a sewing machine includes a flow path switching member, a base portion, and a plurality of thread introducing portions. The flow path switching member includes a gaseous body inlet portion for receiving a compressed gaseous body, a gaseous body outlet portion provided to communicate with the gaseous body inlet portion for exhausting the gaseous body, and a cylindrical outer surface portion at which the gaseous body outlet portion is opened. The base portion includes a cylindrical inner surface portion into which the cylindrical outer surface portion of the flow path switching member is inserted and for supporting the flow path switching member in a rotatable manner, and a plurality of flow paths formed to communicate with the cylindrical inner surface portion. The plurality of thread introducing portions are provided at the base portion to communicate with respective outlet sides of the plurality of flow paths.

3 Claims, 8 Drawing Sheets

(56) References Cited

U.S. PATENT DOCUMENTS

2015/0267333 A1 9/2015 Shomura

* cited by examiner

THREADING DEVICE OF A SEWING MACHINE

This application is based on and claims the benefit of priority to Japanese Patent Application No. 2014-239388 filed on Nov. 26, 2014, the contents of which are hereby incorporated by reference in their entirety.

FIELD OF THE INVENTION

The present invention relates to a threading device of a sewing machine.

DESCRIPTION OF THE RELATED ART

An overlock sewing machine is provided with a plurality of loopers. It is necessary to thread each of the loopers with respectively different looper threads. Therefore, threading operations were troublesome.

Patent Literature 1 discloses a device for threading a thread to a hollow looper point using compressed air.

In a threading device, it is necessary to select an upper looper thread or a lower looper thread and to accordingly switch air paths. In the above-mentioned conventional device, an operating portion for switching was slid in lateral directions when seen from the front surface of the sewing machine to select a looper to be threaded.

However, since an air inflow member (the coupling switching member in Patent Literature 1) and a tube (the air supply pipe in Patent Literature 1) are connected to this operating portion, the air inflow member and the tube move laterally each time the operating portion is operated, so that it was necessary to secure additional moving space thereof proximate of the operating portion on the front surface of the sewing machine.

Further, since the tube itself moves laterally, the tube which is a soft floating member was intermixed in a space for various moving parts in the interior of the sewing machine, so that the arrangement was unstable.

PRIOR ART LITERATURE

Patent Literature

[Patent Literature 1] Japanese Patent Laid-Open Publication No. H06-277383

SUMMARY OF THE INVENTION

One or more embodiments of the present invention provides a threading device of a sewing machine which can be further downsized and which can be configured to be of high stability.

Embodiment (1): One or more embodiments of the present invention provide a threading device of a sewing machine in which a thread is introduced into a thread guiding pipe which is selected from among a plurality of thread guiding pipes by using a gaseous body. The threading device includes a flow path switching member, a base portion, and a plurality of thread introducing portions. The flow path switching member includes a gaseous body inlet portion for receiving a compressed gaseous body, a gaseous body outlet portion provided to communicate with the gaseous body inlet portion for exhausting the gaseous body, and a cylindrical outer surface portion at which the gaseous body outlet portion is opened. The base portion includes a cylindrical inner surface portion into which the cylindrical outer surface portion of the flow path switching member is inserted and for supporting the flow path switching member in a rotatable manner, and a plurality of flow paths formed to communicate with the cylindrical inner surface portion such that any one of the flow paths can communicate with the gaseous body outlet portion to correspond to a rotating position of the flow path switching member. The plurality of thread introducing portions are provided at the base portion to communicate with respective outlet sides of the plurality of flow paths, for delivering—the threads inserted into respective thread inserting openings with the gaseous body, to each of the thread guiding pipes.

Embodiment (2): One or more embodiments of the present invention provide a threading device of a sewing machine wherein in the threading device of a sewing machine according to claim 1, the plurality of flow paths is disposed to be symmetric with the cylindrical inner surface portion being the center.

Embodiment (3): One or more embodiments of the present invention provide a threading device of a sewing machine wherein in the threading device of a sewing machine according to claim 1 or 2, the cylindrical inner surface portion is formed by a through hole formed to pierce through the base portion, wherein an operating portion which can rotationally operate the flow path switching member is provided on one side (front side) of the through hole, and wherein the air inlet portion is formed on the other side (rear side) of the through hole.

According to one or more embodiments of the present invention, the threading device can be further downsized and can be configured to be of high stability.

DETAILED DESCRIPTION

A best form for carrying out the present invention will now be explained with reference to the drawings and others.

Embodiment

Figure 1:
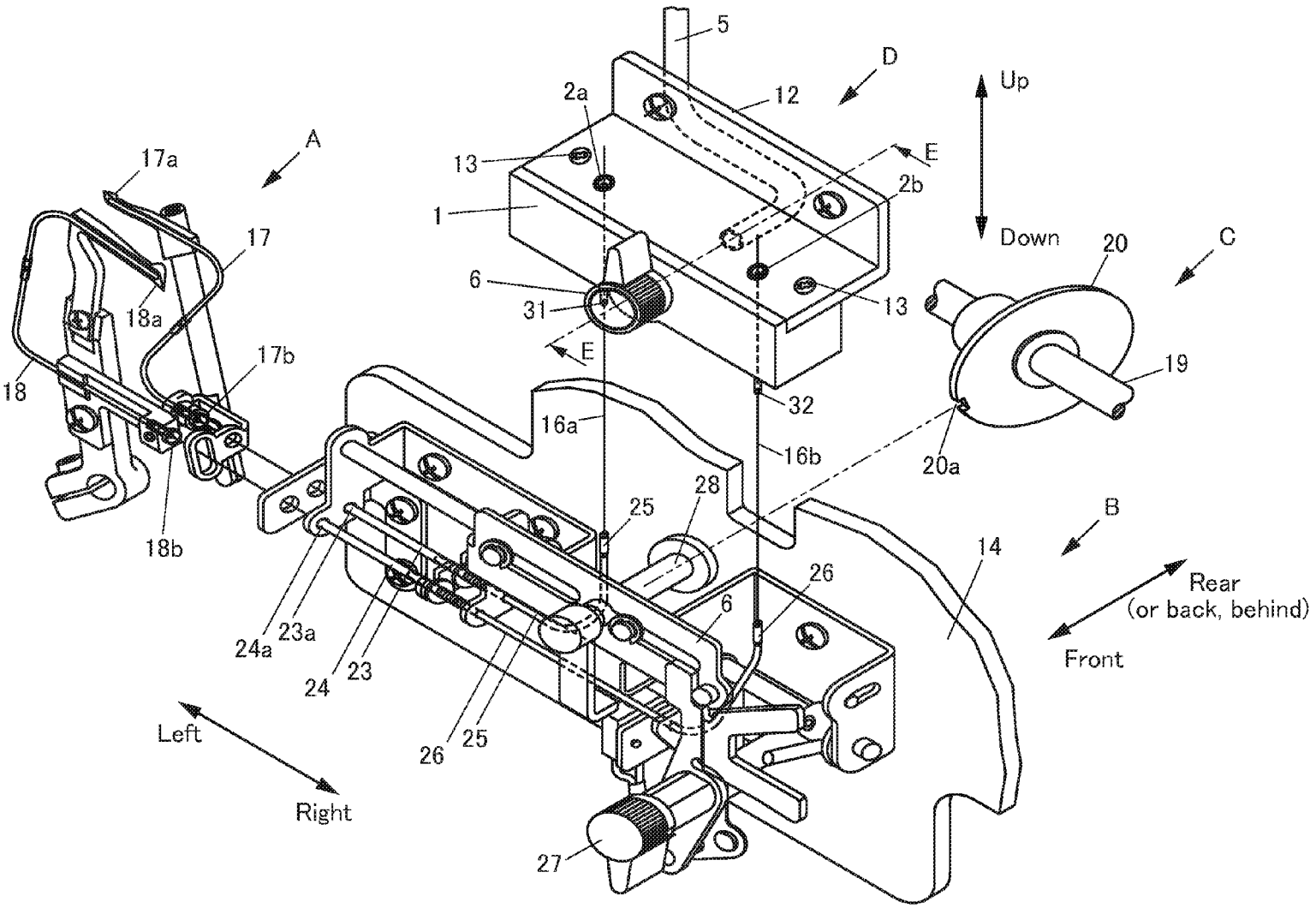
FIG. 1 A perspective view of a main portion showing an overlock sewing machine comprising the threading device according to one or more embodiments of the present invention.

FIG. 1 is a perspective view of a main portion showing one embodiment of an overlock sewing machine comprising the threading device according to the present invention.

In this respect, each of the drawings indicated hereinafter including FIG. 1 are schematically illustrated drawings, and sizes and shapes of respective portions are shown in suitably exaggerated form for ease of understanding.

Further, while explanations are made upon indicating specific numerical values, shapes and materials in the following explanations, they may be suitably changed.

Moreover, for ease of understanding and for convenience sake, explanations will be made by suitably using the six directions of front (or near), rear (or back, behind), left, right, up and down as indicated by arrows in FIG. 1. However, these directions are not to limit the arrangement of the invention.

In the present embodiment, explanations will be made by giving a case of an overlock sewing machine comprising two loopers (upper looper 17, lower looper 18). However, the present invention is also applicable to sewing machines in which threading to one or more than three loopers is performed.

The overlock sewing machine according to the present embodiment includes a looper portion A, an looper thread path B, a main shaft fixing mechanism C and an air flow path switching mechanism D as main configurations as shown in FIG. 1. In this respect, while the overlock sewing machine further comprises needles, a motor and various driving mechanisms, details thereof will be omitted here.

The looper portion A comprises an upper looper 17 and a lower looper 18 including an upper looper point 17*a* and a lower looper point 18*a*. An upper looper thread 16*a* and a lower looper thread 16*b* are delivered to the upper looper point 17*a* and the lower looper point 18*a* by means of the air flow path switching mechanism D and the looper thread path B.

The looper thread path B includes an upper looper conducting pipe 25 and an upper looper sliding pipe 23 which are to be a thread guiding pipe for the upper looper thread 16*a*, and a lower looper conducting pipe 26 and a lower looper sliding pipe 24 which are to be a thread guiding pipe for the lower looper thread 16*b*. When the user rotationally operates a threading switching knob 27, the upper looper sliding pipe 23 and the lower looper sliding pipe 24 move in lateral directions, and their tip portions 23*a*, 24*a* are inserted and removed for an upper looper receiving opening 17*b* and a lower looper receiving opening 18*b*.

The main shaft fixing mechanism C has a function of restricting rotation of a main shaft 19 which rotates at the time of performing sewing. A main shaft fixing outer shaft 28 moves in the front and rear direction together with the rotation of the threading switching knob 27 and is inserted and removed for a notch 20*a* of a main shaft fixing plate 20 integrally provided with the main shaft 19.

Switching between a sewing enabled state and a threading state is performed by the looper thread path B and the main shaft fixing mechanism C. In the sewing enabled state, the main shaft fixing outer shaft 28 is not inserted in the notch 20*a* and the upper looper sliding pipe 23, and the lower looper sliding pipe 24 are remote from the upper looper receiving opening 17 band the lower looper receiving opening 18*b*. On the other hand, in the threading state, the main shaft fixing outer shaft 28 is inserted in the notch 20*a*, so that rotation of the main shaft 19 is restricted. Additionally, the upper looper sliding pipe 23 and the lower looper sliding pipe 24 are inserted in the upper looper receiving opening 17*b* and the lower looper receiving opening 18*b*.

Figure 2:
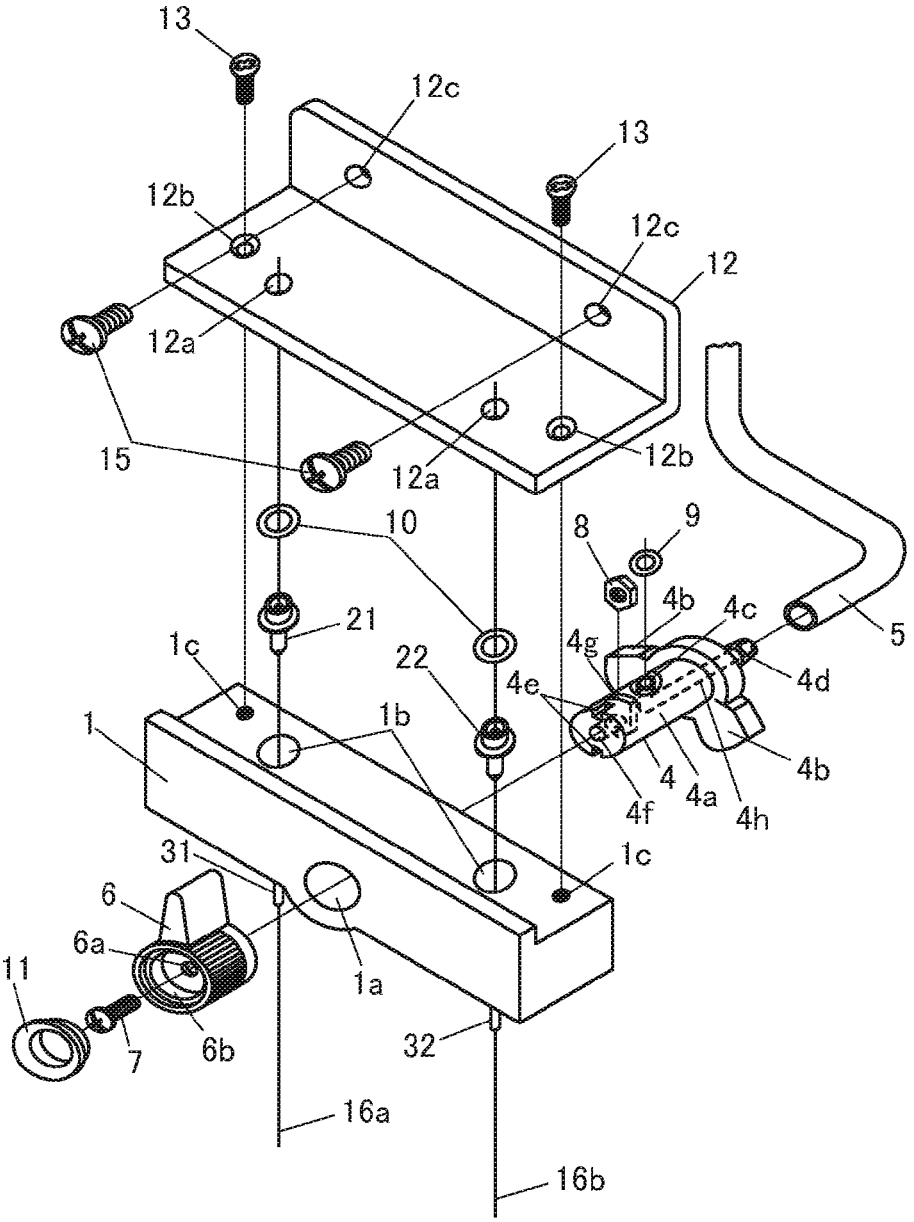
FIG. 2 An exploded perspective view of an air flow path switching mechanism D.

FIG. 2 is an exploded perspective view of the air flow path switching mechanism D.

Figure 3:
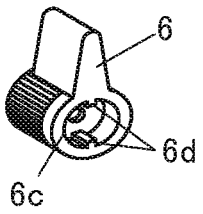
FIG. 3 A perspective view in which a looper selecting knob 6 is seen from a rear surface side.

FIG. 3 is a perspective view in which a looper selecting knob 6 is seen from the rear surface side.

Figure 4:
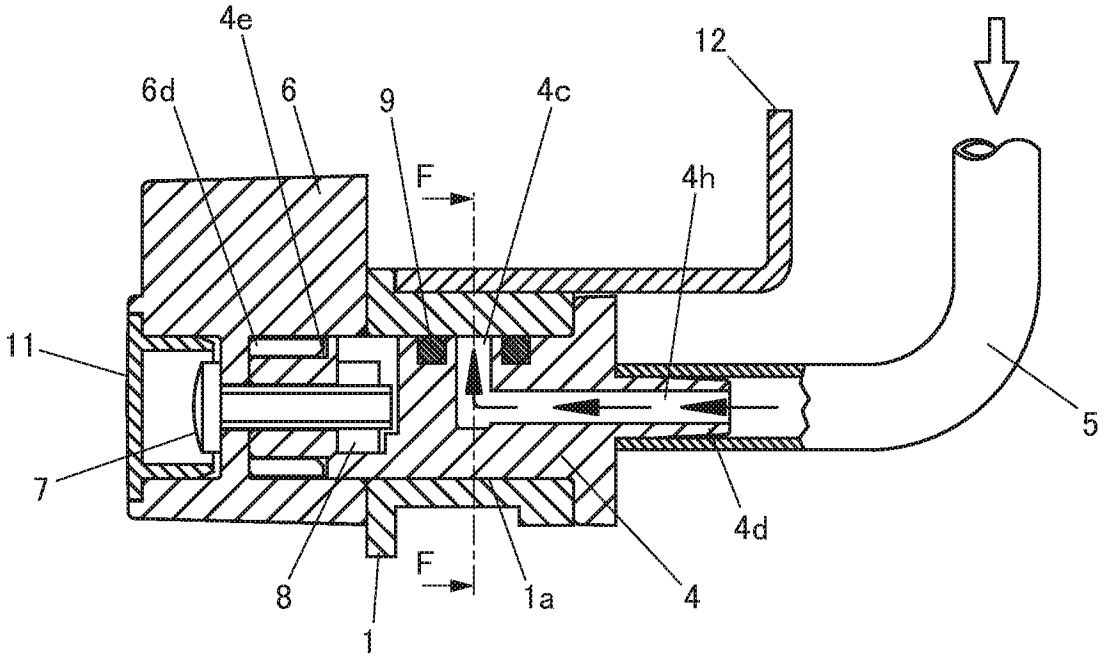
FIG. 4 A sectional view in which the air flow path switching mechanism D is cut at the position of arrow E-E shown in FIG. 1.

FIG. 4 is a sectional view in which the air flow path switching mechanism D is cut at the position of arrow E-E shown in FIG. 1.

Figure 5:
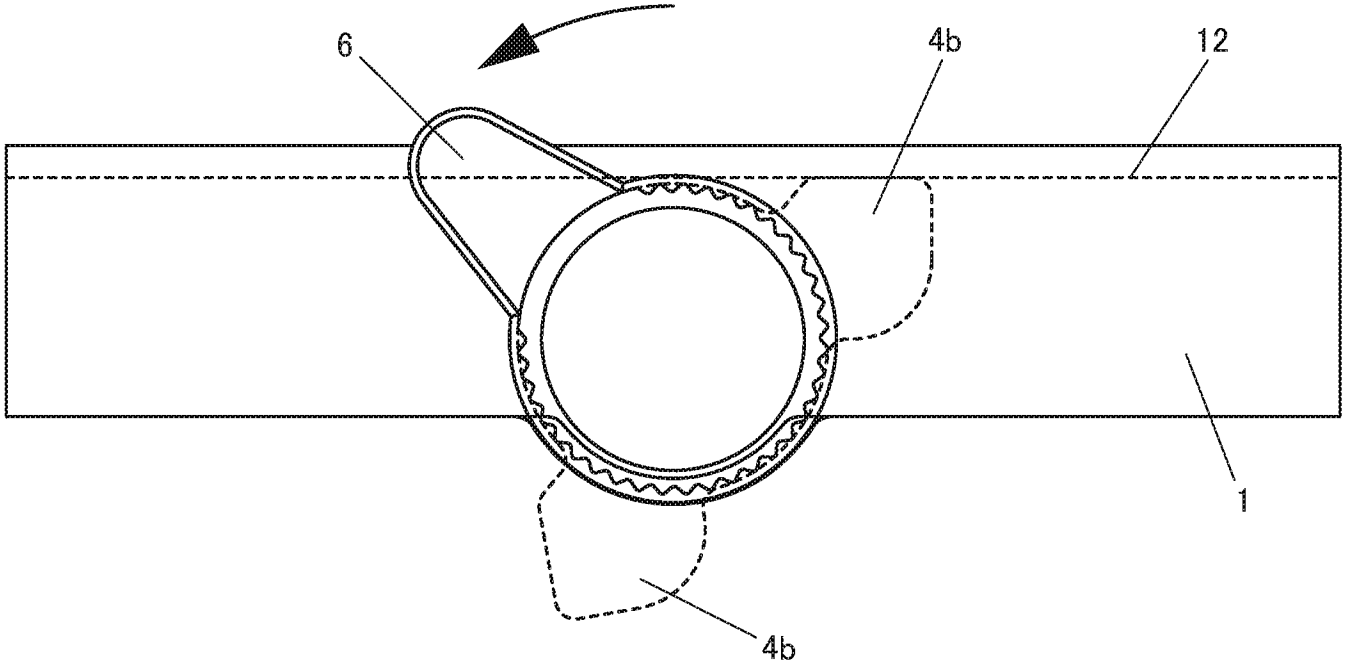
FIG. 5 A view showing a state in which a user has rotated the looper selecting knob 6 counterclockwise when seen from the front to select an upper looper side.

FIG. 5 is a view showing a state in which a user has rotated the looper selecting knob 6 counterclockwise when seen from the front to select an upper looper side.

Figure 6:
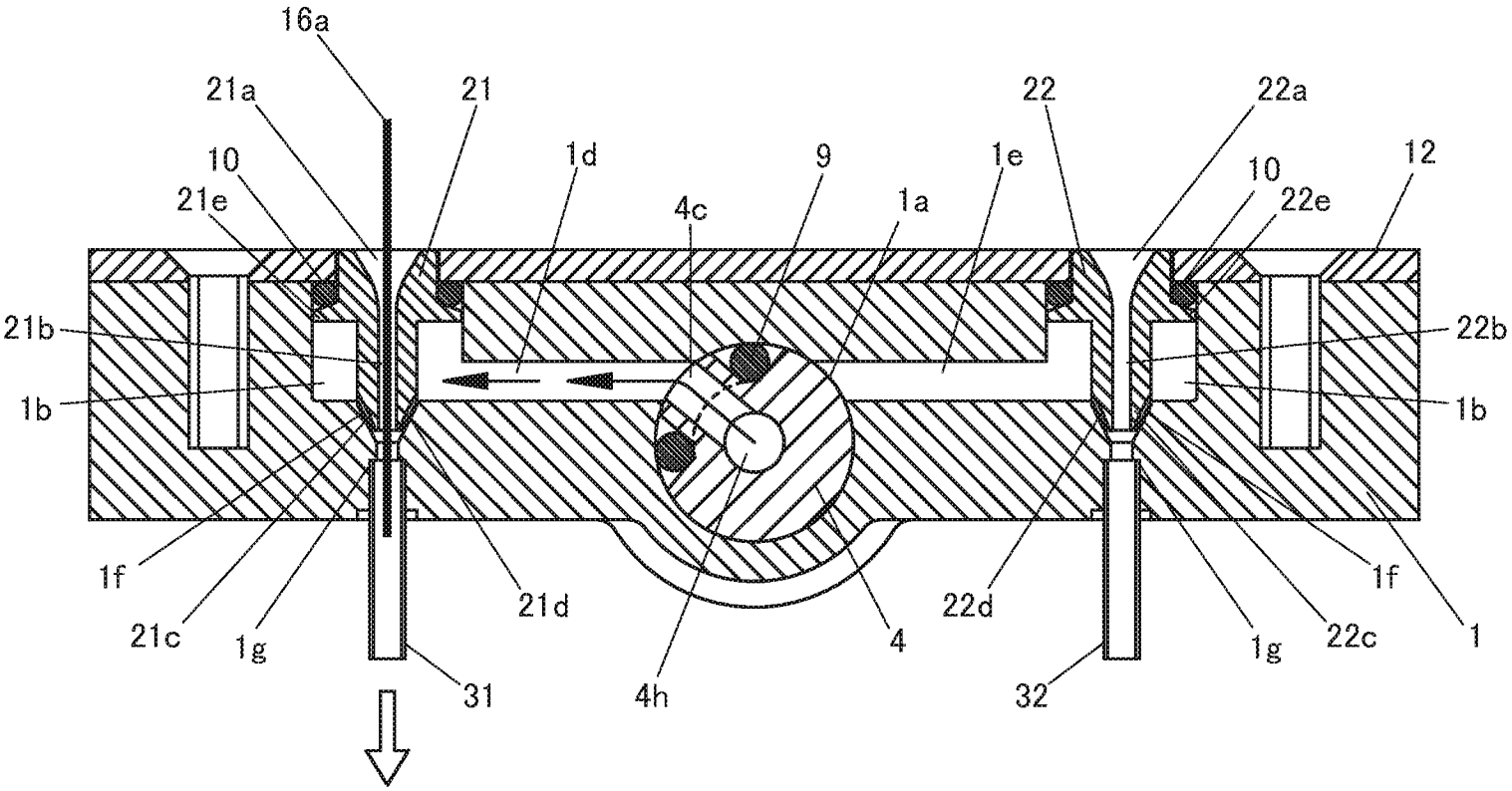
FIG. 6 A sectional view of the air flow path switching mechanism D cut at a position of arrow F-F shown in FIG. 4 in a state in which the upper looper side is selected.

FIG. 6 is a sectional view of the air flow path switching mechanism D cut at a position of arrow F-F shown in FIG. 4 in a state in which the upper looper side is selected.

The air flow path switching mechanism (threading device) D includes a flow path switching base 1, thread introducing portions 21, 22, connecting pipes 31, 32, an air inflow shaft (flow path switching member) 4, a tube 5, the looper selecting knob 6 and a base plate 12.

The flow path switching base (base portion) 1 has a through hole 1*a* in the center thereof, concave portions 1*b* which receive the thread introducing portions 21, 22 at two spots and female screw holes 1*c* at two spots on an upper surface thereof. The connecting pipes 31, 32 are provided at a lower portion of the flow path switching base 1.

The cylindrical outer surface portion 4*a* of the air inflow shaft 4 is inserted into the through hole (cylindrical inner surface portion) 1*a* to support the air inflow shaft 4 in a rotatable manner.

The flow path switching base 1 incorporates the upper looper side flow path 1*d* and the lower looper side flow path 1*e*. The upper looper side flow path 1*d* and the lower looper side flow path 1*e* are disposed to be symmetric with the central through hole 1*a* being the center, and either path flow is selected by the rotation of the air inflow shaft 4.

The thread introducing portions 21, 22 are assembled to the flow path switching base 1, and includes conical thread inserting openings 21*a*, 22*a* and small diameter through holes 21*b*, 22*b* continuing thereto into which threads are inserted from above. Lower cylindrical ends of the thread introducing portions 21, 22 are comprised as conical ends 21*c*, 22*c* formed to have a conical shape, and a plurality of narrow grooves 21*d*, 22*d* are formed on outer peripheries of the conical ends 21*c*, 22*c*. Flange portions 21*e*, 22*e* are formed at intermediate portions which divide upper and lower portions of the thread introducing portions 21, 22. O rings 10 are fitted with the upper portions of the flange portions 21*e*, 22*e* for preventing leakage of compressed air after switching the upper and lower loopers within the flow path switching base 1. The thread introducing portions 21, 22 are provided to communicate with outlet sides of the upper looper side flow path 1*d* and the lower looper side flow path 1*e*, respectively, and deliver the upper looper thread 16*a* and the lower looper thread 16*b* inserted into the thread inserting openings 21*a*, 22*a* to the upper looper conducting pipe 25 and the lower looper conducting pipe 26 together with a gaseous body.

The connecting pipes 31, 32 are respectively connected to holes that are opened at the flow path switching base 1 downward of the thread introducing portions 21, 22. The connecting pipes 31, 32 are also pipe members for respectively connecting to the upper looper conducting pipe 25 or the lower looper conducting pipe 26, which has been switched to either the upper looper side or the lower looper side within the flow path switching mechanism D.

The air inflow shaft (flow path switching member) 4 fits with the through hole 1*a* of the flow path switching base 1 in a rotatable manner. The air inflow shaft 4 includes a cylindrical outer surface portion 4*a*, protrusions 4*b*, an exhaust opening (gaseous body outlet portion) 4*c*, a gaseous body inlet portion 4*d*, fitting grooves 4*e*, a screw through hole 4*f*, a nut receiving chamber 4*g* and a hollow hole 4*h*.

The cylindrical outer surface portion 4*a* is a portion which outer periphery is formed to have a cylindrical shape and to extend in the front and rear direction, and is fitted with the through hole 1*a* in a rotatable manner.

The protrusions 4*b* are formed at two spots rearward of the air inflow shaft 4 to expand and project to the right and left. The protrusions 4*b* restrict a rotatable range of the air inflow shaft 4 by abutting the base plate 12.

The exhaust opening (gaseous body outlet portion) 4*c* is provided to open at the cylindrical outer surface portion 4*a*.

The exhaust opening 4*c* is formed to have a cylindrical shape, and an O ring 9 is disposed at the periphery thereof. Leakage of compressed air is prevented by interposing the O ring 9 between the through hole 1*a* and the air inflow shaft 4.

The gaseous body inlet portion 4*d* is a pipe-like portion provided to project rearward of the air inlet shaft 4 on a cylindrical central axial line of the cylindrical outer surface portion 4*a*. The tube 5 is connected to the gaseous body inlet portion 4*d*.

The gaseous body inlet portion 4*d* and the exhaust opening 4*c* are connected by means of the hollow hole 4*h*. Accordingly, compressed air supplied from the gaseous inlet portion 4*d* passes through the hollow hole 4*h* and is exhausted from the exhaust opening 4*c*.

The fitting grooves 4*e* are provided at a front portion of the air inflow shaft 4, and fit with fitting protrusions 6*d* of the looper selecting knob 6.

A screw 7 for fixing the looper selecting knob 6 passes through the screw through hole 4*f*, so that the air inflow shaft 4 and the looper selecting knob 6 are integrated by means of the screw 7 and a nut 8.

The nut receiving chamber 4*g* for reception is a space in which the nut 8 receiving the screw 7 is accommodated.

The hollow hole 4*h* is provided at a shaft center of the air inflow shaft 4, and connects the gaseous body inlet portion 4*d* and the exhaust opening 4*c*.

The tube 5 is a soft tube connected to a compressed air supplying device (not shown) and the gaseous body inlet portion 4*d*, and transmits compressed air supplied from the compressed air supplying device from the gaseous body inlet portion 4*d* into the air inflow shaft 4.

The looper selecting knob (operating portion) 6 is mounted at a front side of the air inflow shaft 4 to rotate integrally with the air inflow shaft 4. The looper selecting knob 6 is a member which the user operates for selecting whether the upper looper side or the lower looper side when threading. Selecting operations are performed by rotationally operating the knob either clockwise or counterclockwise.

The looper selecting knob 6 includes a screw through hole 6*a*, a concave portion 6*b*, a fitting hole 6*c* and fitting protrusions 6*d*.

The screw through hole 6*a* pierces through the looper selecting knob 6 in the front and rear direction and is open at the center thereof.

The concave portion 6*b* which fits with a cap 11, is provided on a front surface of the looper selecting knob 6.

The fitting hole 6*c* which fits with the cylindrical outer surface portion 4*a* of the air inflow shaft 4, is provided on a rear surface of the looper selecting knob 6.

The fitting protrusions 6*d* which fits with the fitting grooves 4*e* of the air inflow shaft 4, are formed to project towards the inside of the fitting hole 6*c* and.

The base plate 12 is disposed at an upper portion of the flow path switching base 1, and includes window holes 12*a* for the thread introducing portions 21, 22, screw through holes 12*b* for fixing the flow path switching base 1 by means of screws 13, and screw through holes 12*c* for fixing the flow path switching mechanism D to a unit base 14 by means of screws 15. With this arrangement, the base plate 12 fixes the flow path switching base 1 by means of the screws 13 and fixes the flow path switching mechanism D associated with the flow path switching base 1 to the unit base 14.

Next, flow path switching operations of the flow path switching mechanism D will be explained.

For switching the flow paths, the user performs rotating operations of the looper selecting knob 6 either clockwise or counterclockwise to select which of the upper or lower looper is to be threaded and the upper looper thread 16*a* or the lower looper thread 16*b* is inserted to the thread conducting portions 21 or 22 corresponding thereto. Next, the compressed air supplying device (not shown) is operated to make compressed air enter from the tube 5 to the flow path switching mechanism D.

As shown in FIG. 4, the air inflow shaft 4 fitted with the through hole 1*a* of the flow path switching base 1 in a freely rotatable manner and fixes and integrates the looper selecting knob 6 by means of the screw 7 and the nut 8 in a state in which the fitting grooves 4*e* and the fitting protrusions 6*d* are fitted at a front side thereof. With this arrangement, when the looper selecting knob 6 rotates, the air inflow shaft 4 rotates integrally therewith. Compressed air that has entered from the gaseous body inlet portion 4*d* of the air inflow shaft 4 through the tube 5 passes through the hollow hole 4*h* of the air inflow shaft 4 and reaches the exhaust opening 4*c*.

As shown in FIG. 5 and FIG. 6, in a state in which the looper selecting knob 6 is rotationally operated counterclockwise to select the upper looper side, one protrusion 4*b* of the air inflow shaft 4 is in a state in which it abuts a rear surface of the base plate 12. In this state, the exhaust opening 4*c* of the air inflow shaft 4 is stopped at a phase which coincides with that of the upper looper side flow path 1*d* of the flow path switching base 1 in the interior of the flow path switching mechanism D as shown in FIG. 6. The O ring 9 is fitted with the exhaust opening 4*c* and prevents leakage of compressed air flowing in from the exhaust opening 4*c* to the upper looper side flow path 1*d*.

The upper looper side flow path 1*d* communicates with the concave portion 1*b* on the left side wherein the thread introducing portion 21 is disposed at the concave portion 1*b* while interposing the O ring 10 between itself and the base plate 12 for preventing upward leakage of air. The upper end of the thread introducing portion 21 is comprised as the conical thread inserting opening 21*a* and communicates with the small diameter through hole 21*b*. The lower end of the thread introducing portion 21 is comprised as the conical end 21*c* with the small diameter through hole 21*b* piercing through its center, and the plurality of the narrow grooves 21*d* is formed on the outer peripheral surface of the conical end 21*c*.

At the center of a bottom of the concave portion 1*b* of the flow path switching base 1, a conical hole 1*f* and a stepped hole 1*g* continue from a center of the conical hole, and the connecting pipe 31 is fixed to the lower end of the stepped hole 1*g*.

The conical end 21*c* of the thread introducing portion 21 fits with the conical hole 1*f*, and compressed air which has reached the concave portion 1*b* passed through the plurality of narrow grooves 21*d* of the thread introducing portion 21 to reach from the stepped hole 1*g* to the connecting pipe 31.

When passing the narrow grooves 21*d*, a flow of air of increased flow velocity is generated, and the upper looper thread 16*a* inserted from the thread inserting opening 21*a* of the thread introducing portion 21 is delivered to the connecting pipe 31 together with this air flow.

Figure 7:
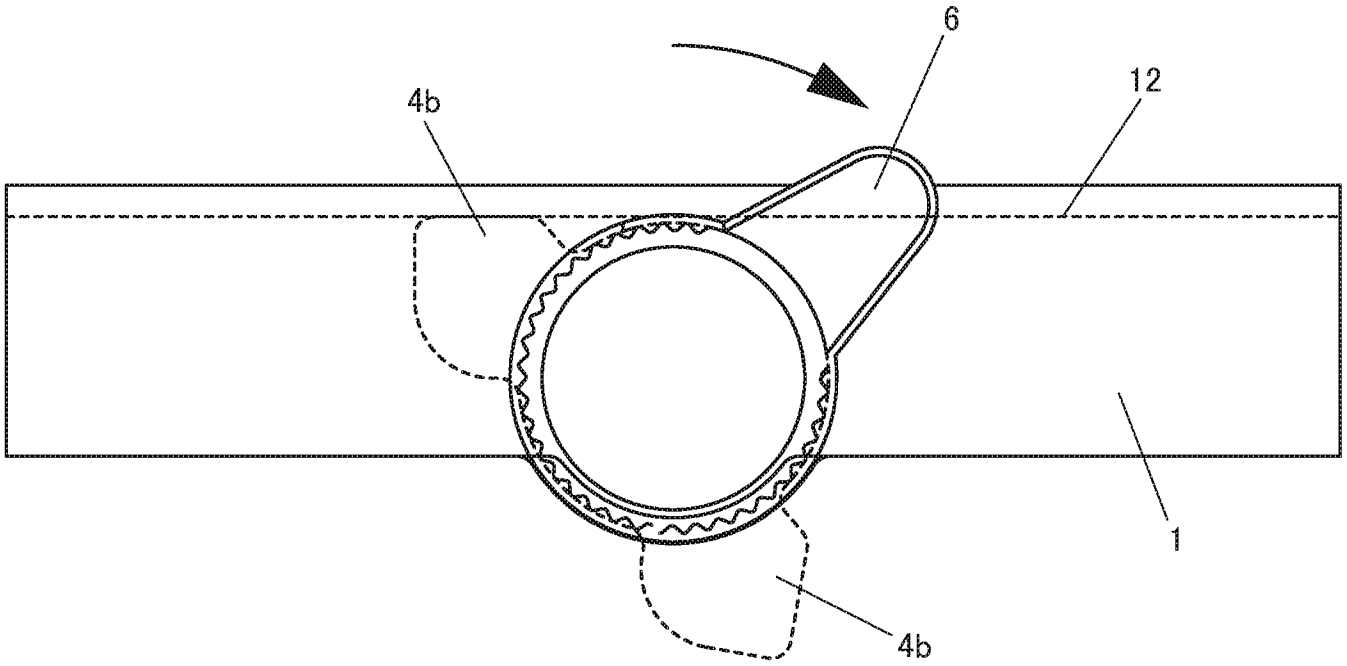
FIG. 7 A view showing a state in which a user has rotated the looper selecting knob 6 in a clockwise direction when seen from the front to select a lower looper side.

FIG. 7 is a view showing a state in which a user has rotated the looper selecting knob 6 clockwise when seen from the front to select the lower looper side.

Figure 8:
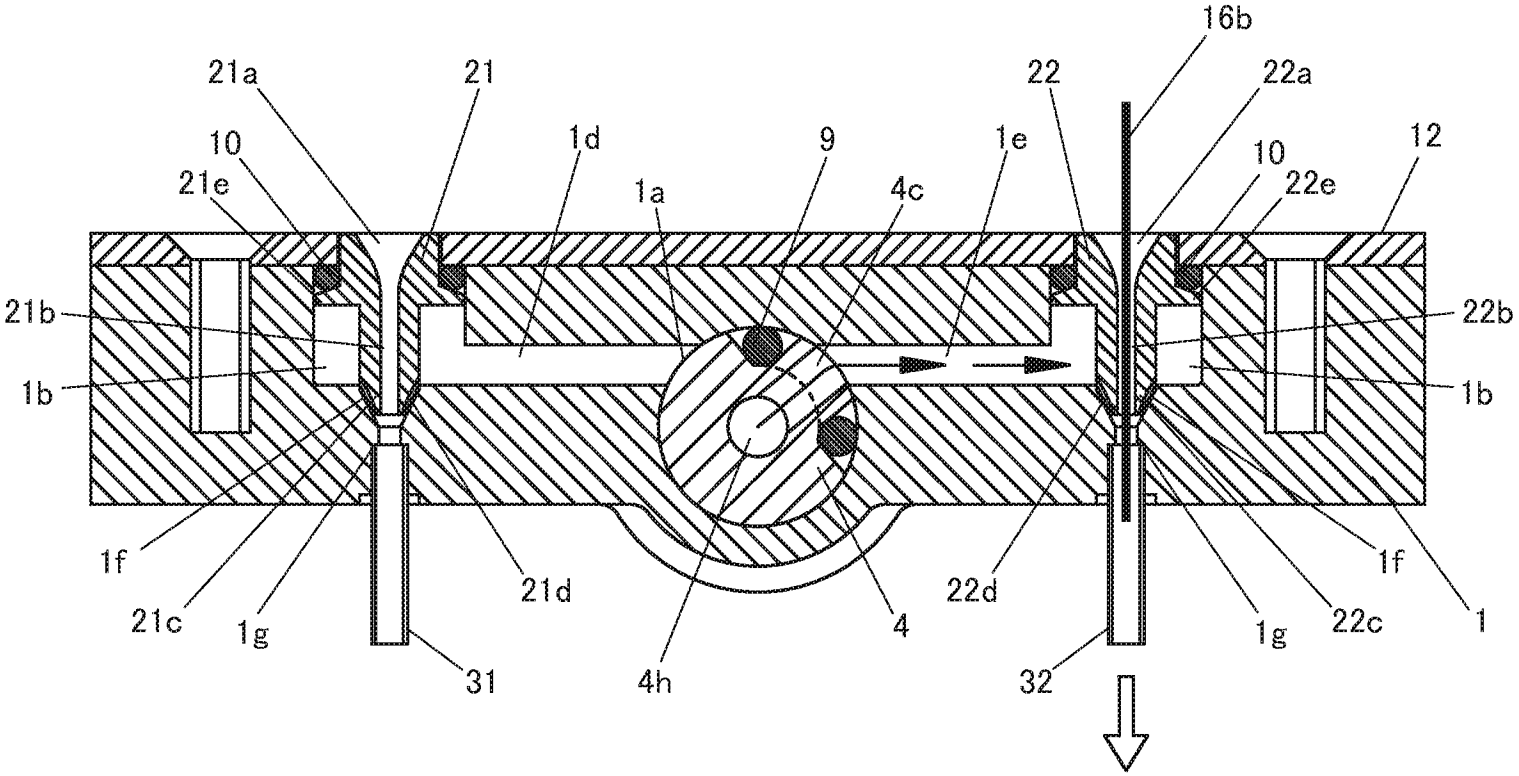
FIG. 8 A sectional view of the air flow path switching mechanism D cut at the position of arrow F-F shown in FIG. 4 in a state in which the lower looper side is selected.

FIG. 8 is a sectional view of the air flow path switching mechanism D cut at the position of arrow F-F shown in FIG. 4 in a state in which the lower looper side is selected.

As shown in FIG. 7 and FIG. 8, in a state in which the looper selecting knob 6 is rotationally operated clockwise to select the lower looper side, the protrusion 4*b* opposite to the side in a state in which the upper looper side is selected is in a state in which it abuts the rear surface of the base plate 12. In this state, the exhaust opening 4*c* of the air inflow shaft 4 is stopped at a phase which coincides with that of the lower looper side flow path 1*e* of the flow path switching base 1 in the interior of the flow path switching mechanism D as shown in FIG. 8. The O ring 9 is fitted with the exhaust opening 4*c* and prevents leakage of compressed air flowing in from the exhaust opening 4*c* to the lower looper side flow path 1*e*.

The configuration of the upper looper side extending from the upper looper side flow path 1*d* over the thread introducing portion 21 up to the connecting pipe 31 and the configuration of the lower looper side extending from the lower looper side flow path 1*e* over the thread introducing portion 22 up to the connecting pipe 32 are disposed to be symmetric with the through hole 1*a* as the center. Accordingly, the following configurations and operations are identical to those of the case of the above-described upper looper side.

Namely, the lower looper side flow path 1*e* communicates with the concave portion 1*b* on the right side wherein the thread introducing portion 22 is disposed at the concave portion 1*b* while interposing the O ring 10 between itself and the base plate 12 for preventing upward leakage of air. The upper end of the thread introducing portion 22 is comprised as the conical thread inserting opening 22*a* and communicates with the small diameter through hole 22*b*. The lower end of the thread introducing portion 22 is comprised as the conical end 22*c* with the small diameter through hole 22*b* piercing through its center, and the plurality of the narrow grooves 22*d* is formed on the outer peripheral surface of the conical end 22*c*.

At the center of the bottom of the concave portion 1*b* of the flow path switching base 1, the conical hole 1*f* and the stepped hole 1*g* continue from the center of the conical hole, and the connecting pipe 32 is fixed to the lower end of the stepped hole 1*g*.

The conical end 22*c* of the thread introducing portion 22 fits with the conical hole 1*f*, and compressed air which has reached the concave portion 1*b* passed through the plurality of narrow grooves 22*d* of the thread introducing portion 22 to reach from the stepped hole 1*g* to the connecting pipe 32. When passing the narrow grooves 22*d*, a flow of air of increased flow velocity is generated, and the lower looper thread 16*b* inserted from the thread inserting opening 22*a* of the thread introducing portion 22 is delivered to the connecting pipe 32 together with this air flow.

After passing the connecting pipes 31, 32, the upper looper thread 16*a* or the lower looper thread 16*b* is delivered with compressed air upon passing the looper thread path B up to the upper looper point 17*a* or the lower looper point 18*a*.

As explained so far, according to the air flow path switching mechanism (threading device) D of the present embodiment, since basic operations for switching the flow paths are of rotating style and switching of the flow paths is performed by means of the rotating air inflow shaft 4, the delivering spot of compressed air will not move in a sliding manner. Accordingly the space required for switching can be reduced. Namely, in a condition in which various operating parts of the overlock sewing machine come close to each other, there is no necessity of particularly securing a moving space for components which are moved by the flow path switching operations. Particularly, since the connecting portion of the tube 5 is coincident with the center of rotation of the air inflow shaft 4, there is no necessity of considering moving the tube 5, and the position of the tube which is a soft floating member can be secured so as to provide a configuration of high stability.

Further, in the air flow path switching mechanism (threading device) D of the present embodiment, as a place at which distribution of compressed air takes place is focused at the cylindrical outer surface portion 4*a* of the air inflow shaft 4, it is possible to improve the air leakage preventing performance.

Modified Embodiment

The present invention is not limited to the above-described embodiment, and various modifications and changes are possible which are included in the scope of the present invention.

The present embodiment has been explained by giving a case as an example in which two flow paths are switched in the air flow path switching mechanism. The present invention is not limited to this, and the air flow path switching mechanism might, for instance, be configured to switch three or more flow paths.

Further, the present embodiment has been explained by giving a case as an example in which the tube 5 is directly connected to the gaseous body inlet portion 4*d* of the air inflow shaft 4. The present invention is not limited to this, and it is, for instance, possible to provide a rotating joint between the tube 5 and the gaseous body inlet portion 4*d* of the air inflow shaft 4 with freely rotating connecting portions so as not to transmit rotation of the air inflow shaft 4 to the tube 5.

In this respect, while the embodiments and modified embodiments might be used upon suitably combining them, detailed explanations thereof will be omitted. Further, the present invention is not to be limited by the above-explained embodiments.

REFERENCE SIGNS LIST

A Looper portion
B Looper thread path
C Main shaft fixing mechanism
D Air flow path switching mechanism
1 Flow path switching base (base portion)
1*a* Through hole
1*b* Concave hole
1*c* Female screw hole
1*d* Upper looper side flow path
1*e* Lower looper side flow path
1*f* Conical hole
1*g* Stepped hole
4 Air inflow shaft
4*a* Cylindrical outer surface portion

4*b* Protrusion
4*c* Exhaust opening (gaseous body outlet portion)
4*d* Gaseous body inlet portion
4*e* Fitting groove
4*f* Screw through hole
4*g* Nut receiving chamber
4*h* Hollow hole
5 Tube
6 Looper selecting knob
6*a* Screw through hole
6*b* Concave portion
6*c* Fitting hole
6*d* Fitting protrusion
7 Screw
8 Nut
9, 10 O ring
11 Cap
12 Base plate
12*a* Window hole
12*b*, 12*c* Screw through hole
14 Unit base
16*a* Upper looper thread
16*b* Lower looper thread
17 Upper looper
17*a* Upper looper point
17*b* Upper looper receiving opening
18 Lower looper
18*a* Lower looper point
18*b* Lower looper receiving opening
19 Main shaft
20 Main shaft fixing plate
20*a* Notch
21 Thread introducing portion
21*a* Thread inserting opening
21*b* Small diameter through hole
21*c* Conical end
21*d* Narrow groove
21*e* Flange portion
22 Thread introducing portion
22*a* Thread inserting opening
22*b* Small diameter through hole
22*c* Conical end
22*d* Narrow groove
22*e* Flange portion
23 Upper looper sliding pipe
23*a* Tip end portion
24 Lower looper sliding pipe
24*a* Tip end portion
25 Upper looper conducting pipe
26 Lower looper conducting pipe
27 Switching knob
28 Main shaft fixing outer shaft
32, 32 Connecting pipe

The invention claimed is:

1. A threading device of a sewing machine in which a thread is introduced into a thread guiding pipe which is selected from among a plurality of thread guiding pipes by using a gaseous body, comprising:

a flow path switching member including a gaseous body inlet portion for receiving a compressed gaseous body, a single gaseous body outlet portion provided to communicate with the gaseous body inlet portion for exhausting the gaseous body, the gaseous body being exhausted out of the flow path switching member only though the single gaseous body outlet portion, and a cylindrical outer surface portion at which the gaseous body outlet portion is opened;

a base portion including a cylindrical inner surface portion into which the cylindrical outer surface portion of the flow path switching member is inserted and for supporting the flow path switching member in a rotatable manner, and a plurality of flow paths formed to communicate with the cylindrical inner surface portion such that any one of the flow paths can communicate with the gaseous body outlet portion to correspond to a rotating position of the flow path switching member; and a plurality of thread introducing portions provided at the base portion to communicate with respective outlet sides of the plurality of flow paths, for delivering-the threads inserted into respective thread inserting openings with the gaseous body, to each of the thread guiding pipes, wherein the gaseous body inlet portion has a cylindrical shape, and a central axis of the gaseous body inlet portion is coincident with a rotational axis of the flow path switching member;

wherein the single gaseous body outlet portion extends in a radial direction of the flow path switching member; and wherein the threading device comprises a tube connected to the gaseous body inlet portion, and a rotating joint disposed between the tube and the gaseous body inlet portion, so as not to transmit rotation of the flow path switching member to the tube.

2. The threading device of a sewing machine according to claim 1, wherein the plurality of flow paths is disposed to be symmetric with the cylindrical inner surface portion being the center.

3. The threading device of a sewing machine according to claim 1, wherein the cylindrical inner surface portion is formed by a through hole formed to pierce through the base portion wherein an operating portion which can rotationally operate the flow path switching member is provided on one side of the through hole, and wherein the air inlet portion is formed on the other side of the through hole.

* * * * *